US005778930A

United States Patent [19]

Friedrichsen et al.

[11] Patent Number: 5,778,930

[45] Date of Patent: Jul. 14, 1998

[54] ADD-IN DEVICE FOR A HYDRAULIC CONTROL ARRANGEMENT

[75] Inventors: Welm Friedrichsen, Nordborg; Thorkild Christensen, Sønderborg, both of Denmark

[73] Assignee: Danfoss A/S, Nordborg, Denmark

[21] Appl. No.: 565,229

[22] Filed: Nov. 30, 1995

[30] Foreign Application Priority Data

Dec. 7, 1994 [DE] Germany ..... 44 43 462.6

[51] Int. Cl.[6] ..... F15B 13/08

[52] U.S. Cl. ..... 137/596.13; 91/31; 137/884

[58] Field of Search ..... 137/596.13, 884; 91/31

[56] References Cited

U.S. PATENT DOCUMENTS

Re. 31,529 3/1984 Lowe ..... 137/884

4,330,008 5/1982 Skelly ..... 137/596.13

*Primary Examiner*—Gerald A. Michalsky

*Attorney, Agent, or Firm*—Lee, Mann, Smith, McWilliams, Sweeney & Ohlson

[57] ABSTRACT

An add-in device for a hydraulic control arrangement provides a function unit (24) to be arranged between successive modules, which function unit takes the connection between the pump channels of the preceding and the subsequent module by way of at least one function slide valve (117, 217) which is arranged to be displaced into several positions. In its positions this function slide valve initiates different functions, by which fluid under pressure is arranged to be admitted to the subsequent control module in at least two different amounts and/or in at least two different levels of pressure. In this manner operation of the subsequent control modules can be better matched to the particular operating conditions that obtain.

13 Claims, 4 Drawing Sheets

ADD-IN DEVICE FOR A HYDRAULIC CONTROL ARRANGEMENT

BACKGROUND OF THE INVENTION

The invention relates to an add-in device for a hydraulic control arrangement.

Control arrangements of that kind are known, for example, from the Danfoss brochure entitled "Directional Valve Proportional Valve Type PVG 32"(HD.57.A1.02) from 1988, pages 4 and 5. Several control modules, to each of which a load is attached, and a pump module, to which a pump and a tank are connected, lie end to end and form a compact structural unit. For example, a control module contains a control slide valve preceded by a compensating valve holding the pressure drop at the control slide valve constant, so that a proportional valve is produced with which the amount of fluid under pressure to be supplied to the load can be controlled. The load pressure can be sensed and used to control the pump pressure. Pressure-limiting valves can also be provided. In all cases the function data, in particular the limit values of the amount flowing through and the pressure, are fixed in both working directions for the entire working range. This often requires compromises which prevent optimum use of the control arrangement.

SUMMARY OF THE INVENTION

The invention is therefore based on the problem of finding a way in which a hydraulic control arrangement of the kind described in the introduction can be better adapted to the particular operational conditions that obtain.

This problem is solved by an add-in device having the features of the invention.

This add-in device enables the following control modules to have graduated amounts and/or pressures supplied to them, which then override the basic setting of the individual control modules. The change-over to different amounts and/or pressures can take place at any time so that each load can be operated within its working range with different functions. For example, for a crane that is mounted on a motor vehicle, different safety zones can be provided in dependence on its position and its load and the functions introduced by the add-in device can be selected so that tipping and overloading of the crane are both prevented. Operation of the add-in device can be effected manually, but is preferably computer-controlled in dependence on control signals that are emitted by sensors mounted on the crane.

According to one form of the invention different flow-through volumes are determined which limit the admission to the downstream loads.

The arrangement of pressure-limiting valves enables different pressure limit values to be determined in a simple manner.

According to the invention, the admission of fluid under pressure to the following control modules can also be completely interrupted.

In the preferred embodiment, two add-in modules corresponding in their basic construction to the control modules are proposed for the function unit. By using two selected tank channels the block in the pump channel can be bridged and at the same time different functions can be set.

If both add-in modules have a function slide valve according to the invention, even further functions can be switched in.

The invention compensates for the fact that the selected tank channels in the two add-in modules are not available for return of the fluid under pressure.

In one embodiment, the add-in module can be of largely identical construction with a control module. Generally, it is sufficient for the load connections to be closed by a stopper and the function slide valve or the slide valve bore to be changed. This increases productivity because the add-in modules can be manufactured jointly with the control modules and require only slight modification.

Preferred forms of first and second add-in modules according to the invention are set forth below.

The development of the invention provides two flow paths, which lead from the central control channel to the control channel of the selected tank channel or vice versa. Throttling losses are thus kept low.

BRIEF DESCRIPTION OF THE DRAWINGS

The invention is explained is further detail hereinafter with reference to preferred embodiments illustrated in the drawings, in which.

DESCRIPTION OF THE PREFERRED EMBODIMENTS

Figure 1:
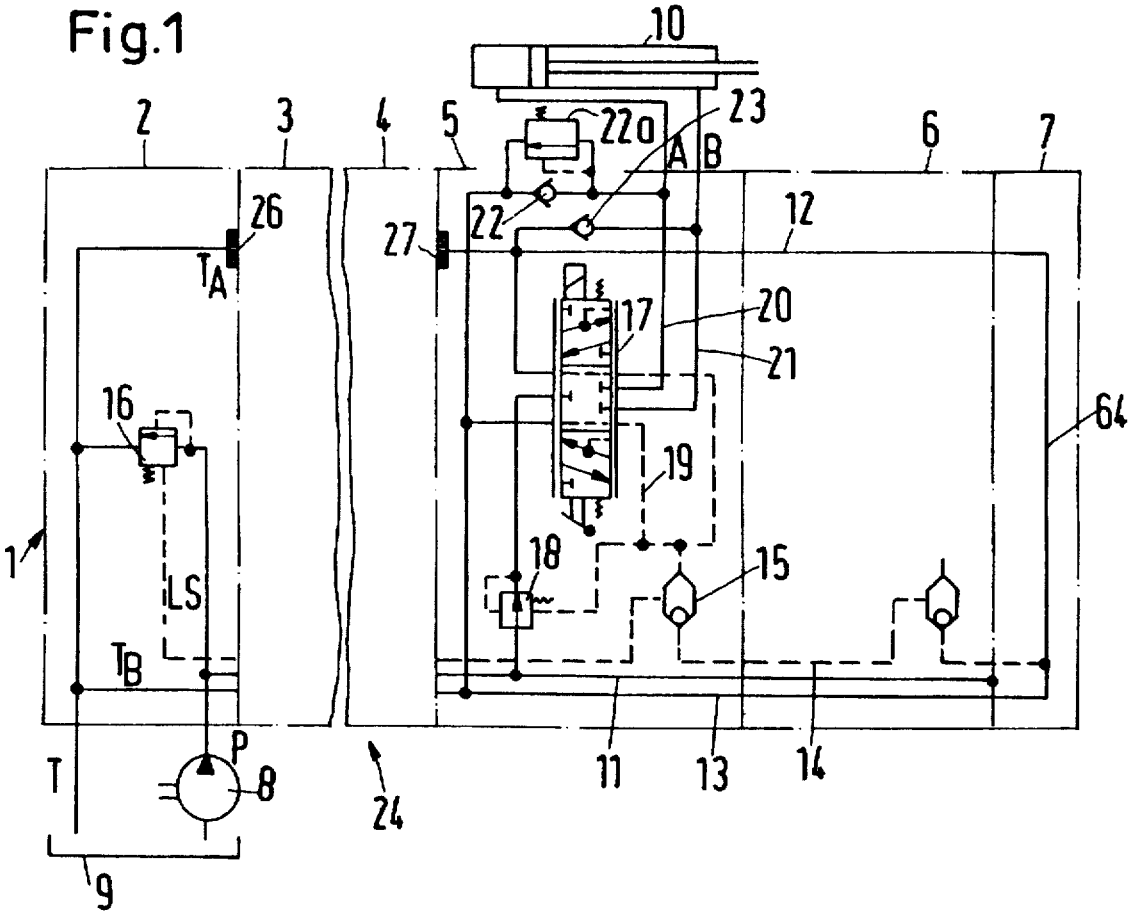
FIG. 1 is a simplified illustration of a hydraulic control arrangement, in which the add-in device according to the invention can be used.

The hydraulic control arrangement illustrated in FIG. 1 consists of a stack 1 of modules, namely, a pump module 2, a first add-in module 3, a second add-in module 4, a first control module 5, a second control module 6 and a supplementary module 7. The pump module 2 has a pump connection P to which a pump 8 is attached, and a tank connection T to which a tank 9 is attached. Each of the control modules 5 and 6, of which there may also be a larger number, serves to control a load 10 which is connected by way of two load connections A and B to the control module.

The control modules 5 and 6 have pump channels 11, tank channels 12 and 13 and load pressure channels 14, which fit end to end in the chosen arrangement of stacking and therefore provide a continuous connection. If the pump module 2 directly adjoins the control module 5, the pump channels 11 are connected to a pump connection P, the tank channels 11 are connected to tank connections $T_A$ and $T_B$, and the load pressure channels 14 are connected to a load pressure connection LS. By means of change-over valves 15 in the control modules 5, 6, the highest load pressure in each case is detected and controls a discharge valve 16 in the pump module 2 with the result that the output pressure of the pump 8 producing a constant delivery volume is adjusted to the highest load pressure. Instead of that, the load pressure can also control a pump of variable volume.

The control module 5 contains a control slide valve 17, which can be adjusted, for example, electro-magnetically. A compensating valve 18 which keeps the pressure drop at the control slide valve 17 constant is provided at the input side, for which purpose internal load pressure lines 19 are provided. In this manner, a proportional valve is produced, which is connected by way of two load channels 20 and 21 to the load connections A and B. An intake valve 22 is connected between the load channel 20 and the tank channel 13, and an intake valve 23 is connected between the load channel 21 and the tank channel 12. Each of the two intake valves has connected in parallel thereto a respective pressure-limiting valve 22*a*, 23*a* with an adjustable limit value. The control module 5 may contain numerous other components, as is generally customary.

Figure 2:
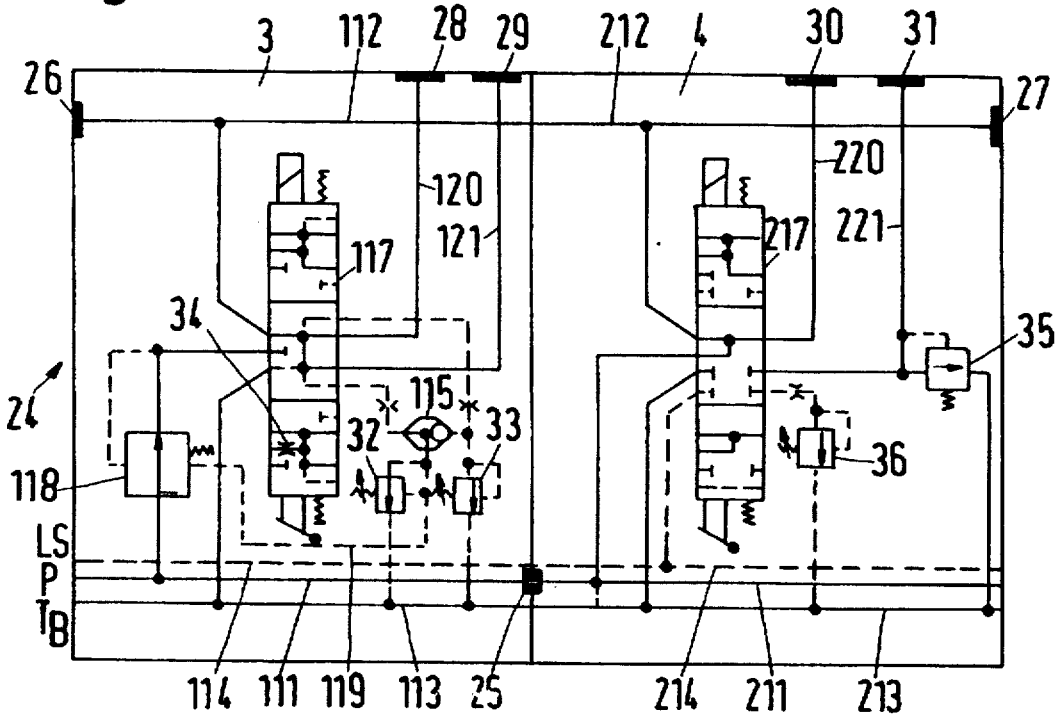
FIG. 2 is the circuit of two add-in modules, as can be used in FIG. 1.

According to the invention, a function unit 24 consisting of the two add-in modules 3 and 4 is preceded by at least one of the control modules, in the embodiment illustrated, all control modules. Its construction is illustrated in FIG. 2. Each of the two add-in modules 3 and 4 has a respective pump channel 111, 211 which are separated from one another by a blocking device 25. They have respective selected tank channels 112, 212 which are provided at their ends remote from each other with blocking devices 26 and 27 which prevent a connection to the pump module 2 and the control module 5 respectively. Furthermore, non-selected tank channels 113 and 213 are provided which provide a continuous connection between control module 5 and pump module 2, and also continuous load pressure channels 114 and 214. Each add-in module has a respective function slide valve 117, 217 which can be displaced, in this embodiment electromagnetically, but also manually or in some other manner, from the illustrated neutral position into two working positions. The two channels 120, 121 and 220, 221 corresponding to the load channels are closed by stoppers 28, 29, and 30, 31 respectively. The add-in modules 3 and 4 are therefore of largely identical construction with one another and with the control modules, which is expressed here by the use of reference numbers increased by 100 and 200 respectively.

In the first add-in module 3, the function slide valve 117 is preceded by a compensating valve 118 which keeps the pressure drop at the function slide valve 117 constant. For that purpose, internal load pressure channels 119 are provided. They are supplemented by a change-over valve 115 and two pressure-limiting valves 32 and 33 which can be set to different limit values. The function slide valve 117, which in its neutral position blocks the admission of fluid, in its two working positions connects the input side to the selected tank channel 112, the throttle resistance owing to the use of an additional throttle 34 being different in the two working positions.

In the second add-in module 4, the function slide valve 217 connects the selected tank channel 212 to the pump channel 211 in all three positions. The interconnected tank channels 112 and 212 are therefore part of a path by-passing the blocking device 25, in the course of which the fluid under pressure can be acted upon in different ways. That purpose is served in the second add-in module 4 by a pressure-limiting valve 35, which is connected between the load channel 221 and the tank channel 213 and in which one working position is rendered effective, and by a pressure-limiting valve 36 which in the other working position lies in a line that connects the load pressure channel 214 to the tank channel 213.

In the embodiment illustrated, the fluid under pressure can be treated in the following manner, regardless of the measures taken in the individual control modules 5 and 6; in the neutral position of the function slide valve 117, the admission of fluid under pressure to the control modules 5 and 6 is blocked. In one working position of the function slide valve 117 there is a large flow volume and in the other working position, in which the throttle 34 is effective, there is a smaller flow volume, which cannot be exceeded. Both flow volumes can be given an upper limit of pressure or a level of pressure by means of the pressure-limiting valves 32 and 33. By operating the function slide valve 217, two further maximum pressures or levels of pressure can be selected by means of the pressure-limiting valves 35 and 36. With an unchanged setting of the control slide valve in the control module, these additional adjustment options enable pressure and volume changes to be made which allow optimum operation, in particular from a safety point of view. For example, volume adjustment with the control slide valve 117 is ineffective if the volume set by the function slide valve 117 is to be overridden. Likewise, the limit of pressure set in the control module by the pressure-limiting valve 22*a*, 23*a* is ineffective if a lower pressure has been set by means of the add-in modules 3, 4.

Figure 3:
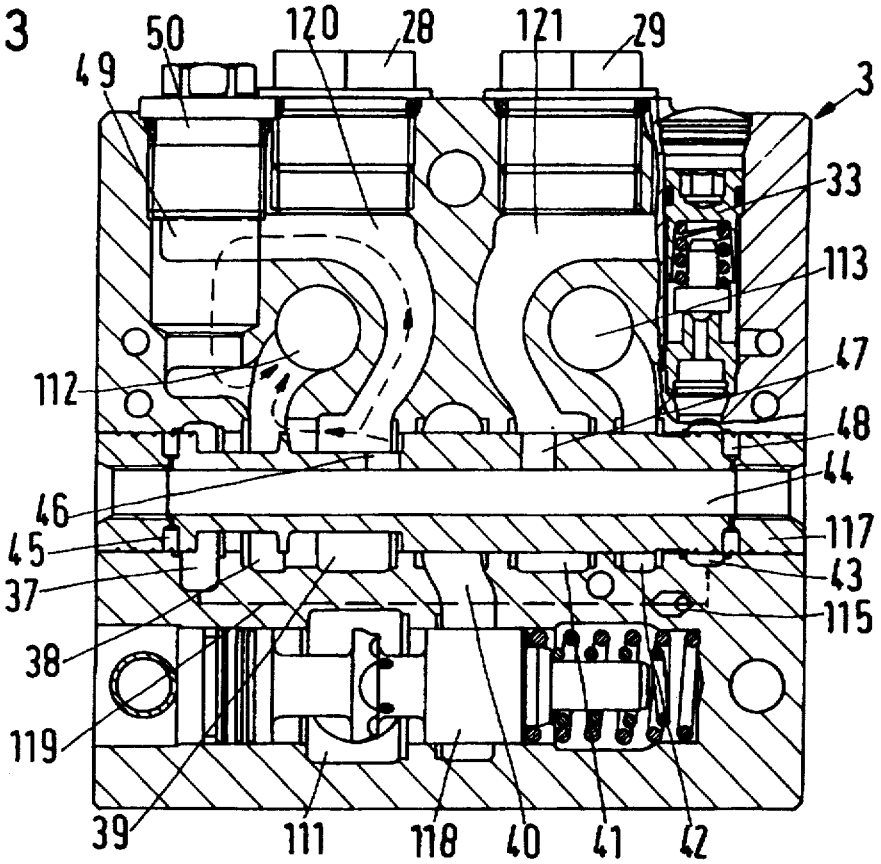
FIG. 3 is a section through the housing of a first add-in module.

FIG. 3 shows how the first add-in module 3 can be constructed in practice. The same reference numbers as those used in FIG. 2 have been used for identical parts. The function slide valve 117 is located in a slide valve bore which from left to right has the following control channels: a load-pressure control channel 37, a control channel 38 connected to the selected tank channel 112, a control channel 39 connected to the load channel 120, an input side control channel 40, a control channel 41 connected to the load channel 121, a control channel 42 connected to the non-selected tank channel 113, and a further load pressure control channel 43. The function slide valve 117 has an axial bore 44 from which, likewise looking from left to right, the radial bores 45, 46, 47 and 48 lead. Furthermore, let it be stressed that the load channel 120 is connected by way of a free space 49 to the selected tank channel 112. This space 49 is closed by a stopper 50 and in a control module can receive, for example, the intake valve 22 and/or a corresponding pressure-limiting valve.

In the neutral position illustrated, the inlet side control channel 40 is covered, so that no pressure medium admission is effected. If the function slide valve 117 is displaced to the right, the flow indicated by broken lines is effected, because by removing material from the function slide valve 117 and/or the slide valve bore a direct connection between the inlet-side control channel 40 and the tank-side control channel 38 is possible, and in addition the connection is effected by way of the free space 49. At the same time, the load pressure sensed by way of the bore 46, the axial bore 44 and the bore 45 becomes effective in the load pressure control channel 37; this load pressure acts by way of the internal load pressure line 119 on the one hand by way of the change-over valve 115 on the compensating valve 118 and on the other hand on the pressure-limiting valve 32 (not illustrated in FIG. 3). On displacement of the function slide valve 117 to the left, fluid under pressure at the input side is able to get to the selected tank channel 112 only by way of the bore 47, the axial channel 48 and the bore 46, which together form the throttle 34. The bores 46 and 47 can be drilled in different sizes to define the throttling resistance, depending on the requirements of the user. This affects the position of the compensating valve 118 and thus the amount flowing through. At the same time, the load pressure is passed by way of the bore 48 and the load pressure control channel 43 on the one hand to the change-over valve 115 and on the other hand to the pressure-limiting valve 33. In all three positions, the control channel 42 of the non-selected tank channel 113 is closed.

Figure 4:
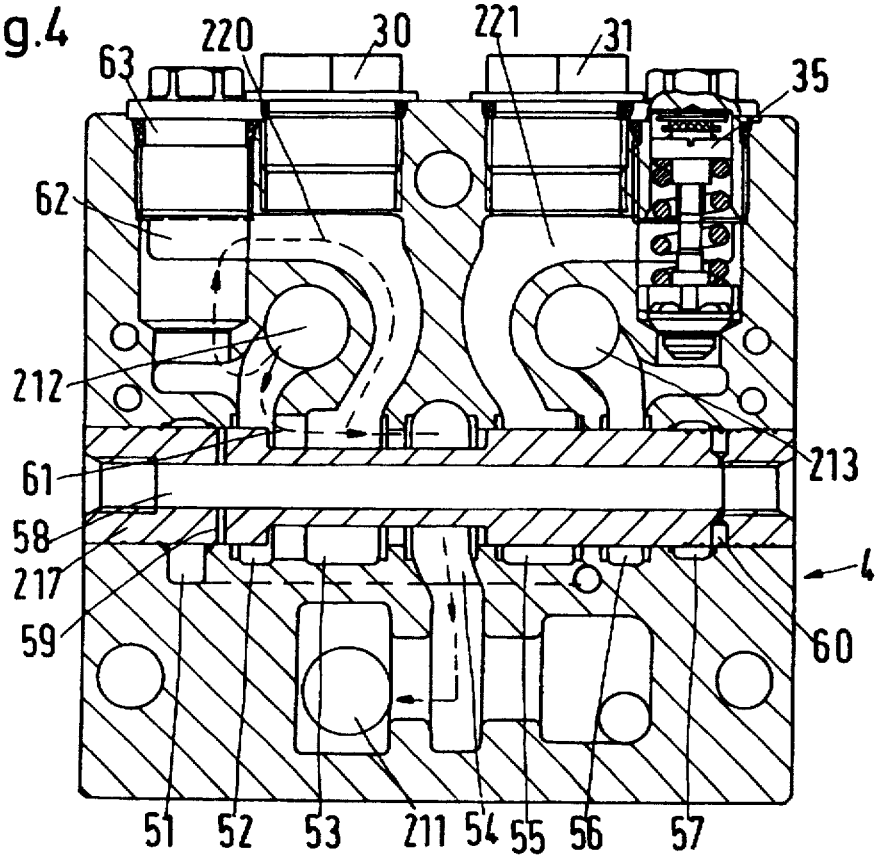
FIG. 4 is a section through the housing of a second add-in module.
Figure 5A:
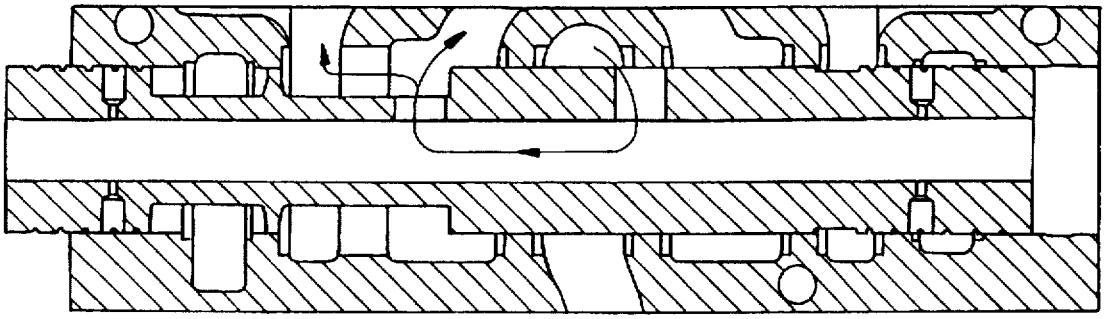
FIGS. 5A–5C are fragment from FIG. 3 with three working positions of the function slide valve and FIGS. 6A–6C are fragment from FIG. 4 with three working positions of the function slide valve.
Figure 5B:
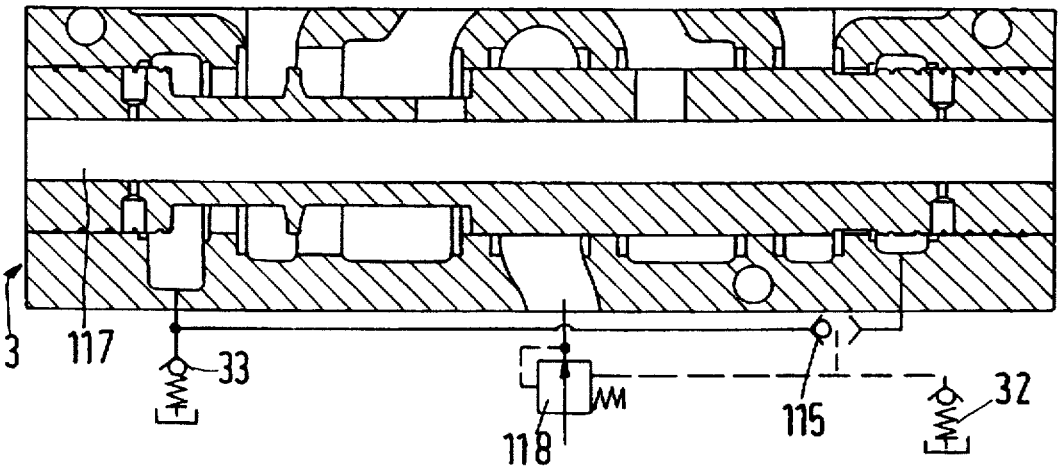
Figure 5C:
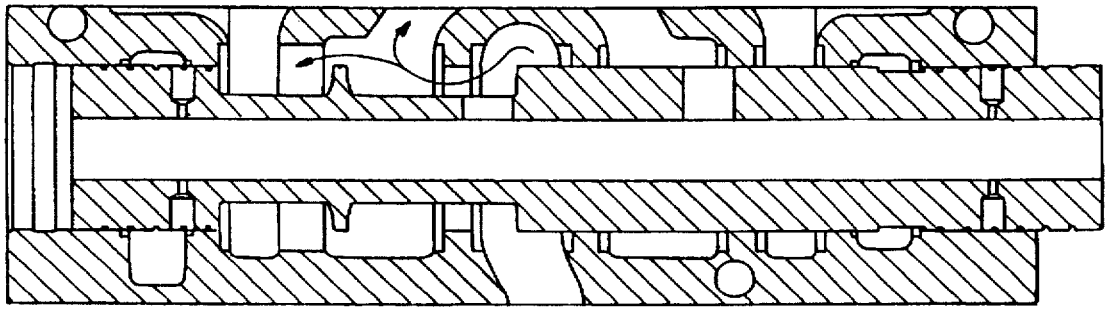
Figure 6A:
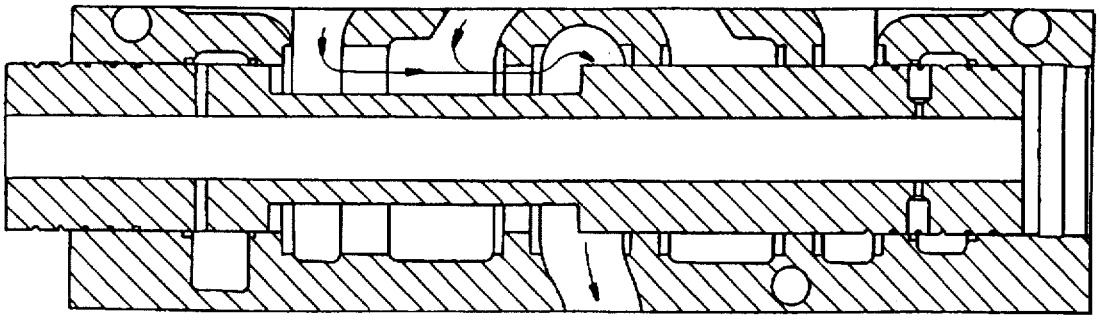
Figure 6B:
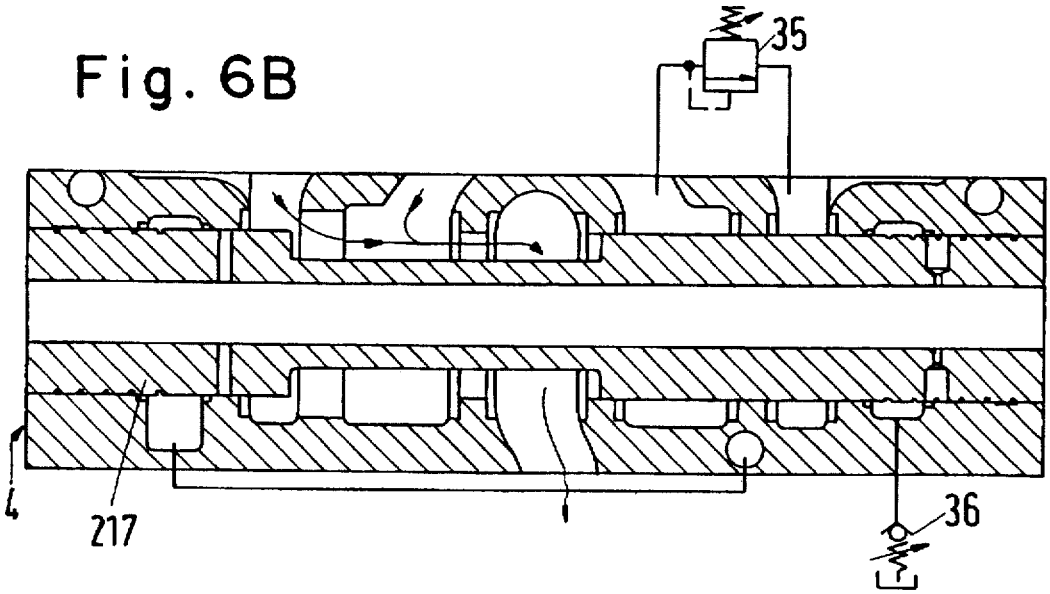
Figure 6C:
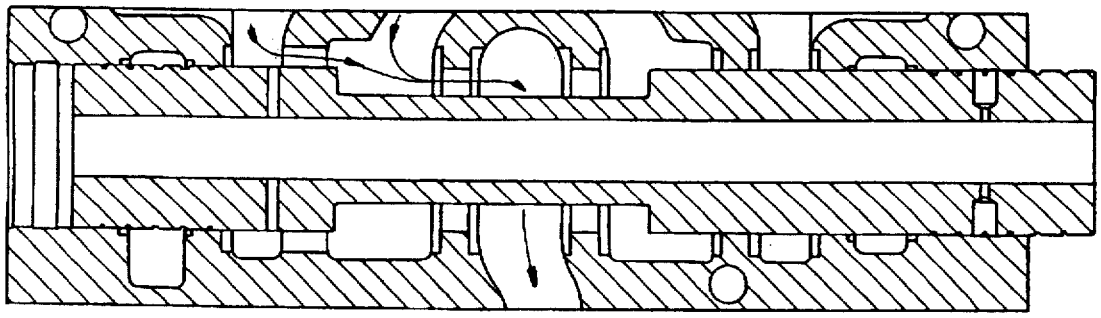

FIG. 4 shows a structural embodiment of the second add-in module 4. The same reference numbers are used for corresponding parts. Here too, the slide valve bore is provided from left to right with the following control channels: a load-pressure control channel 51, a control channel 52 connected to the selected tank channel 212, a control channel 53 connected to the load channel 220, an output side control channel 54, a control channel 55 connected to the load channel 221, a control channel connected to the non-selected tank channel 213, and a load pressure control channel 57. The function slide valve 217 has an axial bore 58 from which two bores 59 and 60 lead and a recess 61 that is large enough so that in all three positions there is a connection between the selected tank channel 212 and the pump channel 211. The control channel 56 of the non-selected tank channel 213 is continuously covered over. In this embodiment too there is a free space 62 which is closed by a stopper 63. This free space is normally occupied by an intake and/or pressure-limiting valve, but in this particular case serves to provide a second flow path between the selected tank channel 212 and pump channel 211.

On displacement of the function slide valve 217 to the left, the load pressure is taken by way of the bore 59, the axial bore 58 and the bore 60 to the load pressure control channel 57, from where it is able to operate the pressure-limiting valve 36. On displacement of the function slide valve 217 to the right, a connection is established between the control channels 55 and 54, so that the pressure-limiting valve 35 can be made effective.

For further details the reader is referred to FIGS. 5A–5C and 6A–6C which show fragments of the two FIGS. 3 and 4 and the three different positions of the function slide valve. The flows produced are indicated by arrows.

The supplementary module 7 contains a connection line 64 which connects the tank channels 12 and 13 to one another, so that fluid under pressure, which escapes in the control modules 5 or 6 to the tank channel 12, can be returned by way of the tank channel 13 to the tank connection T. The supplementary module 7 is advantageously arranged at the end face of the stack 1 remote from the pump, but may alternatively be provided in the form of an intermediate module if the pump, tank and load pressure channels are taken as far as the opposite end face.

In this particular embodiment, a total of four valves are shown, with which different levels of pressure can be determined. Alternatively, yet more of these pressure-limiting valves can be present if there is sufficient space in the module for them and the function slide valves have a suitable number of different working positions. The response values of the pressure-limiting valves are hierarchically arranged so that the different flow-through volumes that can be set by the function slide valve 117 can be operated by means of the pressure-limiting valves 35 and 36 also at a level of pressure other than that determined by the pressure-limiting valves 32 and 33. Fast speed and slow speed for different pressure requirements can be adjusted by suitable combinations of flow-through volume and level of pressure; it is also possible for these combinations to be changed during operation of the load. In particular, the choice can be made in dependence on the particular position of the load, for example, the arm of a crane, and its loading. The critical values are preferably detected by sensors and evaluated in a computer.

By displacing the function slide valve 117 of the first add-in module into the neutral position it is moreover possible to perform an emergency stop. Such an emergency stop would be initiated, for example, if a control slide valve jams and the inconsistency between actual value and desired value of the slide valve position has been detected by a monitoring element. Another safety function which also initiates an emergency stop can comprise activating an electromagnetic valve when jamming of the function slide valve 117 is detected; the pump flow is discharged through this electromagnetic valve directly to the tank. In both cases the modules 5 and 6 no longer contain any fluid under pressure.

Provided that the function slide valve 117 is blocking flow-through, a further hydraulic unit can also be supplied with fluid under pressure; this supply is interrupted when the function slide valve is brought into its working positions.

Further modifications include the setting of a variable flow-through when the function slide valve is displaced in one direction, whereas when displaced in the other direction the pump channel is connected directly to the tank. Equally, a variable limit of pressure could be provided. The use of the load pressure channels and the compensating valve is optional.

We claim:

1. Add-in device for a hydraulic control arrangement which comprises a pump module connected to a pump and at least one control module supplying a load and containing a control slide valve, the control modules having pump channels, tank channels and load pressure channels fitting end to end with one another, the add-in device comprising a function unit arranged between successive ones of the modules, said function unit forming a connection between the pump channel of a preceding module and the pump channel of a following module and having at least one function slide valve for forming the connection, the function slide valve being arranged to be displaced into several positions, the function slide valve including means to initiate different functions in its positions by which fluid under pressure in the pump channel of the preceding module is arranged to be admitted to a subsequent control module in at least one of at least two different amounts and at least two different levels of pressure.

2. Add-in device according to claim 1, including a compensating valve having means to keep pressure drop at the function slide valve constant and including in at least two different positions of the function slide valve means to connect different throttling resistances in series with the compensating valve.

3. Add-in device according to claim 2, including a pressure-limiting valve leading to the tank channel and connected to at least one load pressure channel leading to the compensating valve.

4. Add-in device according to claim 1, in which, in at least one position of the function slide valve, a pressure-limiting valve is connected between the load pressure channel and a tank channel.

5. Add-in device according to claim 1, in which at least one position of the function slide valve output of the function slide valve is connected by a pressure-limiting valve to a tank channel.

6. Add-in device according to claim 1, in which in one setting of the function slide valve connection to the pump channel of the following module is blocked.

7. Add-in device according to claim 1, in which the function unit includes two add-in modules having pump, tank and load pressure channels corresponding to channels of the control modules, and in which add-in modules pump channels are blocked with respect to one another and selected tank channels to a preceding and to a following module are blocked, the first add-in module having a function slide valve which in at least two positions connects its pump channel to its selected tank channel, and the second add-in module including means to connect its selected tank channel continuously to its pump channel.

8. Add-in device according to claim 7, in which the second add-in module has a function slide valve, both function slide valves being formed to perform different functions.

9. Add-in device according to claim 7, including a supplementary module, said supplementary module having means to connect the tank channels of the control modules extending in continuation of the tank channels of the add-in modules with at least one other tank channel.

10. Add-in device according to claim 7, in which at least one add-in module is substantially identical to a control module, the load connections of said identical add-in module being closed by a stopper.

11. Add-in device according to claim 10, in which the first add-in module has an input-side middle control channel covered over in a neutral position of the function slide valve and in working positions is connected by paths having different throttling resistance to the selected tank channel, while a control channel of a non-selected tank channel remains continuously covered.

12. Add-in device according to claim 10, in which the second add-in module has an output-side middle control channel connected continuously to a selected tank channel while a control channel of a non-selected tank channel remains continuously covered.

13. Add-in device according to claim 10, in which a control channel of one load connection, which control channel is located between a middle control channel and a control channel of a selected tank channel, is connected to a selected tank channel by a valve-receiving space, and including a closure stopper in said receiving space.

* * * * *